US005785509A

United States Patent [19]

Harris et al.

[11] Patent Number: 5,785,509

[45] **Date of Patent: *Jul. 28, 1998**

[54] WELLBORE MOTOR SYSTEM

[76] Inventors: Gary L. Harris, 5902 Bent Tree Ct., Humble, Tex. 77346; Hector D. Susman, 9 Graigston Gardens, Westhill, Aberdeen, Scotland, AB32-6NL

[ * ] Notice: The term of this patent shall not extend beyond the expiration date of Pat. No. 5,518,379.

[21] Appl. No.: 650,284

[22] Filed: May 20, 1996

Related U.S. Application Data

[63] Continuation-in-part of Ser. No. 456,790, Jun. 1, 1995, Pat. No. 5,518,379, which is a continuation-in-part of Ser. No. 181,693, Jan. 13, 1994, abandoned.

[51] Int. Cl.[6] ..... F01C 1/356; F01C 19/04; E21B 4/02; E21B 21/00

[52] U.S. Cl. ..... 418/11; 418/124; 418/179; 418/188; 418/225; 418/249; 175/107; 166/312

[58] Field of Search ..... 418/11, 113, 122–124, 418/179, 183, 188, 221, 225, 249; 175/107; 166/312

[56] References Cited

U.S. PATENT DOCUMENTS

| | | | |
|---|---|---|---|
| 807,421 | 12/1905 | Dickison | 418/225 |
| 888,806 | 5/1908 | Hopkins | 418/124 |
| 970,942 | 9/1910 | Moses | 418/225 |
| 1,892,217 | 12/1932 | Moineau | 74/458 |
| 1,997,184 | 4/1935 | Ruehman | 418/225 |
| 2,660,402 | 12/1953 | Devine et al. | 175/107 |
| 2,725,013 | 11/1955 | Vlachos | 418/225 |
| 2,870,747 | 1/1959 | Gurries | 121/86 |
| 3,016,019 | 1/1962 | Rineer | 418/221 |

(List continued on next page.)

FOREIGN PATENT DOCUMENTS

| | | | |
|---|---|---|---|
| 978151 | 12/1948 | France . | |
| 2567571 | 12/1983 | France . | |
| 944190 | 6/1956 | Germany | 418/188 |
| 1266648 | 7/1957 | Germany . | |
| 900044 | 1/1982 | U.S.S.R. | 418/188 |
| 856687 | 12/1960 | United Kingdom . | |
| 1291720 | 10/1972 | United Kingdom . | |
| 2201734 | 9/1988 | United Kingdom . | |
| 90/09510 | 8/1990 | WIPO . | |
| 93/08374 | 4/1993 | WIPO . | |
| 94/16198 | 7/1994 | WIPO . | |

OTHER PUBLICATIONS

"New Directions in Down-Hole Drilling," Robbins & Myers, one page, prior to 1993.

"Robbins & Myers, Inc.," Robbins & Myers, one page, prior to 1993.

"Vari-Flo Motir," Volker Stevin Offshore (U.K.) Ltd., two pages, prior to 1993.

"The Vari-Flo Motor: A New Mud Motor Concept, its Design, Development and Applications," Susman, 6 pages, 1992.

*Primary Examiner*—John J. Vrablik
*Attorney, Agent, or Firm*—Guy McClung

[57] ABSTRACT

A drilling motor has been developed with a hollow tubular stator having at least one rod recess therein and an inlet port therethrough corresponding to each of the at least one rod recess; a rod movably disposed in each of the at least one rod recess; a tubular rotor movably disposed within the stator for rotation therein, the tubular rotor having a central motive fluid flow channel therethrough and extending along the length of the rotor, the rotor having one or more radial exhaust flow channels therethrough for providing a motive fluid flow path to the central motive fluid flow channel from at least one action chamber between the hollow tubular stator and tubular rotor; the tubular rotor having at least one rotor seal; and the at least one action chamber defined by an interior surface of the hollow tubular stator and an exterior surface of the tubular rotor, each of the at least one action chamber sealed at one end by the rod and at another end by one of the at least one rotor seals. A rotor has been developed with a central motive fluid flow channel and one or more radial flow channels interconnected therewith for fluid to flow from action chambers, e.g. action chambers between the rotor and a stator of a drilling motor.

15 Claims, 9 Drawing Sheets

U.S. PATENT DOCUMENTS

| | | | |
|---|---|---|---|
| 3,048,120 | 8/1962 | Ohyagi | 418/188 |
| 3,076,514 | 2/1963 | Garrison | 175/107 |
| 3,088,529 | 5/1963 | Cullent et al. . | |
| 3,103,893 | 9/1963 | Henning et al. | 103/120 |
| 3,120,154 | 2/1964 | Gilreath . | |
| 3,574,493 | 4/1971 | Hamilton | 418/268 |
| 3,838,953 | 10/1974 | Peterson | 418/186 |
| 3,840,080 | 10/1974 | Berryman | 175/107 |
| 3,966,369 | 6/1976 | Garrison | 418/149 |
| 4,009,973 | 3/1977 | Heinrich | 418/104 |
| 4,105,377 | 8/1978 | Mayall | 418/173 |
| 4,462,469 | 7/1984 | Brown | 175/40 |
| 4,485,879 | 12/1984 | Kamp et al. | 175/61 |
| 4,492,276 | 1/1985 | Kamp | 175/61 |
| 4,813,497 | 3/1989 | Wenzel | 175/74 |
| 4,817,740 | 4/1989 | Beimgraben | 175/74 |
| 5,030,071 | 7/1991 | Simpson | 418/13 |
| 5,052,501 | 10/1991 | Wenzel et al. | 175/74 |
| 5,171,138 | 12/1992 | Forrest | 418/48 |
| 5,171,139 | 12/1992 | Underwood et al. | 418/48 |
| 5,171,140 | 12/1992 | Schafer et al. | 418/55.2 |
| 5,174,391 | 12/1992 | Zijsling | 175/57 |
| 5,174,392 | 12/1992 | Reinhardt | 175/107 |
| 5,195,882 | 3/1993 | Freeman | 418/171 |
| 5,337,840 | 8/1994 | Chancey et al. | 175/107 |
| 5,350,242 | 9/1994 | Wenzel | 384/97 |
| 5,518,379 | 5/1996 | Harris et al. | 418/11 |

WELLBORE MOTOR SYSTEM

RELATED APPLICATION

This is a continuation-in-part of U.S. application Ser. No. 08/456,790 filed Jun. 1, 1995, now Pat. No. 5,518,379, which was a continuation in-part of Ser. No. 08/181,693 filed Jan. 13, 1994, abandoned.

BACKGROUND OF THE INVENTION

1. Field of the Invention

This invention relates to drilling motors, to drilling apparatus with two power sections, and to rolling vane drilling motors.

2. Description of Related Art

Drilling motors have been a useful addition to apparatus used in the rotary drilling of oil and gas wells. Rotary drilling systems for drilling wellbores several miles deep with a corresponding string of drill pipe and drill collars in the earth are common. However there are circumstances in the process of drilling a wellbore that require improved techniques; e.g. in directing a wellbore in a manner other than the wellbore direction normally obtained by rotary drilling.

Certain conventional drilling (or "Moineau") motors have a variety of problems associated with their use, including their length and the fact that they are limited environmentally to a temperature of 250° F. due to the use of a rubber stator. Such stators are also subject to attack by solvents and/or caustic or acidic solutions used in the drilling environment. The vane motor has no rubber and is typically shorter in length than Moineau motors. If sealed properly, it is impervious to drilling liquids.

In a typical procedure, prior to drilling a horizontal hole, a conventional rotary string of drill pipe, collars and drill bit is used to drill a vertical or non-horizontal wellbore to a pre-defined kick-off depth. At that depth, a drilling motor (with a bend e.g. of one to three degrees) and a steering tool, are inserted to the correct depth. Pumps at the surface of the earth are started to pump fluid to the drilling motor so it turns and begins to cut the formation. The bend in the motor causes forces at the bit that overcome both the gravity loading and the formation forces applied to the bit so the bit deviates from the direction in which the assembly would normally proceed. The steering tool signals wellbore inclination with respect to gravity of the hole as well as the direction or the wellbore with respect to magnetic north. An arced hole is created in a predetermined direction and depth. When a predetermined location is reached, the bent part of the motor may be at an unsatisfactory angle. The drilling assembly is removed and replaced with a different motor, e.g. at a one degree bend, and the hole is re-entered. The new assembly maintains the predetermined path of the wellbore. The horizontal section of the hole is maintained by carefully rotating the steering tool and the motor with its angular bend so that wellbore direction is controlled and the effects of gravity are also overcome.

Drilling motors are also used on coiled tubing rigs where the drill string is a huge coil of tubing with very few threaded connections that is stored on large rotating spools that lower and raise the bit assembly. Trips of this drill string into and out of the wellbore are made simply by lowering or raising the coil tubing. Such rigs are often used for 'work-over' jobs in which repair or completion of a drilled hole is to be economically performed. Drilling motors are attached to the bottom of the tubing and rotate a bit or cutter of some kind since, in some embodiments, the coiled tubing itself does not normally turn. Fluid from surface equipment is forced down the drill string or coil tubing into the motor which turns and then turns a drill bit.

A typical drilling motor assembly includes a motor section, a bearing section and a bit. The motor turns the bit due to the flow and pressure of a liquid within the conduit of the drill string. The bearing section counteracts loading on the assembly due to both the force of flowing liquid that turns the motor and the load due to the weight of the conduit on the bit. The bearing section also absorbs and counteracts side loading forces and bending forces caused by irregular forces of the formation. The bit applies gouging and ripping forces to remove earth or rock and thus create a hole. Liquids that turn the motor and are then exhausted from it lift the cuttings and carry them outside the drilling conduit back to the surface. Typically the cuttings are discarded and the liquid is recycled to return to the motor.

In rich oilfields, high yield wells will pay for themselves within a matter of weeks through the revenue obtained from the crude oil recovered from such wells. However as depletion progresses, well pressure and well yield decreases in time to levels where normal exploitation is no longer economically viable. As the well ages and pressures decrease, further means to extract still substantial amounts of oil present in the formation are employed to extend the useful life of the well. A further factor contributing to decreasing well yields is the gradual precipitation of heavier well product constituents to the inner well bore, thereby impeding flow. Two main types of precipitation are encountered, hard rock like barium sulphate and softer but equally flow-reducing paraffin sand based material. The cleaning out of older well tubing is then required to extend the useful life of the well.

Most methods of well cleaning are based on re-entry of the well with conventional drill pipe or more recently developed coiled tubing. At the end of the tube various tools are used from which chemicals or solvents are pumped into the affected zones to dissolve precipitated material to thus clean the well. Chemical or solvent only based methods are in general much slower and clean the well less thoroughly than mechanical scraping or cutting type operations. Another way of well cleaning and re-stimulation includes the application of combined chemical solvent and mechanical cutting action using coiled tubing with a hydraulically powered drill motor mounted at its end. The motor in turn drives a reaming drill bit or other cutting tool. The driving fluid , in one aspect, is a chemical or solvent which softens the precipitated material for easier and more rapid removal by the cutting tool. Until very recently conventional drill motors of the Moineau type were used with limited success, due to limitations in the type of solvents or chemicals that are compatible with the material present in Moineau motors.

SUMMARY OF THE INVENTION

In one embodiment, a drilling motor according to the present invention has a stator in which is rotatably disposed a rotor. Motive fluid (e.g. compressed nitrogen, air; water, oil-based mud) enters a central channel of the rotor and flows to one or more flow channels which extend through the rotor. The motive fluid flows into an action chamber which is defined by a portion of the exterior surface of the rotor and a portion of the interior surface of the stator. At one end the action chamber is sealed with a seal on the rotor that sealingly abuts the interior of the stator. At the other end the action chamber is sealed by the sealing abutment of the exterior surface of the rotor and a rolling vane movably disposed in a vane recess in the stator. Preferably the rotor and stator are designed and configured so that there are two opposed action chambers (or some multiple of two chambers), one on either side of the rotor, and two opposed rolling vanes for symmetric power production. An exhaust port, one associated with each action chamber, extends through the stator to exhaust the motive fluid from the action chamber at the end of a power stroke of the rotor. It is within the scope of this invention to have only one action chamber, or an odd number of multiple action chambers.

In one system according to the present invention two motors like the motor described above are used in series with appropriate top and bottom connectors or subs and an intermediate connecting union. Metal blocks are used above and below each motor with appropriate seals and flow is permitted from one motor to the next. In one aspect a portion of total input motive fluid flows through the first motor, powering it by flowing through its rotor, and another portion of the motive fluid flows through the first motor's central rotor channel to power the second motor. In one preferred embodiment the two motors are out of phase (e.g., with two action chambers in each motor, about ninety degrees out of phase; with four action chambers in each motor they are preferably about forty five degrees out of phase; etc) so that there is no interruption in power output due to a momentary power cessation during the short exhaust period of one of the motors.

The rolling vanes are forced by the motive fluid from their stator recesses.

The present invention also provides a drilling rig including a drill string provided with drilling apparatus in accordance with the invention and a well tool rotatable by said drilling apparatus. The well tool may be a drill bit although it could comprise, for example, a rotatable cleaning head. The well tool could also be a drill used to dig a pit (sometimes preferred to as a "glory hole") in the sea bed to house sub-sea well head equipment.

In one embodiment a motor according to the present invention provides a more versatile cleaning motor, with no rubber parts other than O-rings made of materials suitable for the application and with a metal stator instead of a rubber stator as in the Moineau motor. Drive fluids useful in such a motor include, but are not limited to, solvents, acids, Gasoil, (a rubber attacking cutting solvent), hydrochloric acid (plus rubber degrading pacifiers), naphtha, brine water, fresh water and dry nitrogen gas. In one aspect such a motor is externally similar to conventional motors except for its relatively shorter length and the absence of rubber. The motor has two short hollow metal rotor/stator arrangements. Motive liquid or gas enters an upper power module and about half of the fluid flows to an upper motor and about half flows to a lower motor. About half of the drive fluid exits a rotor of the upper motor rotor radially and the balance of the fluid continues downward to a lower module and the lower motor. In both modules the radially diverted fluids enter an annular space between the rotors and stators. Two loose fitting metal rollers, acting as seals between outlet low pressure and inlet high pressure spaces, are situated in recesses cut in the stator walls. When fluid at high pressure enters the high pressure spaces, fluid flow in the direction of the low pressure spaces forces the rollers out of the recesses in the stator blocking further flow in that direction. Further fluid under high pressure entering the high pressure spaces then forces the rotor to rotate with a force directly proportional to the pressure of the fluid and the exposed surface area of the rotor. Fluid from the previous rotational cycle is expelled from the power sections of the motor through channels in the stators. For a short angular period while the rotors are pushing rollers back in their respective recesses to prepare for the next power cycle, no high pressure fluid enters the high pressure space. This would cause a dead spot in the rotation of the motor. To overcome this two rotors are connected out of phase with respect to each other, e.g. in certain embodiments at an angle of 90 degrees, so that one rotor always has full fluid flow and pressure forcing it to rotate in the desired direction. (Alternatively two stators could be disposed out of phase or some combination of out-of-phase stators and rotors may be used.) The rotors in such embodiments rotate in simple rotational motion and not in an orbital manner as with a Moineau motor, thus precluding the need for a complicated universal joint. Simple spline couplings connect the rotors to each other and to a drive shaft to convey generated torque to the drive shaft and to a tool, e.g. a bit. Such a motor may run on dry nitrogen or natural gas, which is a further advantage for cleaning operations on low pressure wells, where fluid based well cleaning methods would damage the formation resulting in stopping production altogether and requiring expensive well stimulation procedures to restore production. The ability of such a motor to run at high temperature makes it useful as a drill motor for geothermal exploration work as well as "hot hole" work. The relatively short overall length of such a motor makes it very useful for directional drilling applications.

In certain embodiments the present invention discloses a motor system for rotating a tool attached thereto, the motor system having a first motor and a second motor interconnected with the first motor, each motor having a housing, a hollow tubular stator secured in the housing having at least two stator recesses therein and at least two exhaust ports therethrough, a rolling stator rod seal movably disposed in each stator recess and freely movable therein and therefrom, a tubular rotor movably disposed within the stator for rotation therein, the tubular rotor having an interior motive fluid flow channel therethrough and extending along the length of the rotor, the rotor having at least two continuously open radial flow channels therethrough for providing a motive fluid flow path for flow of motive fluid from the interior motive fluid flow channel to action chambers from which said fluid flows to the at least two opposed exhaust ports and to the tool, the tubular rotor having at least two rotor recesses and solid rolling rotor rod seals in each rotor recess, each rolling rotor rod seal freely movable from the rod recesses by force of the motive fluid to sealingly contact the stator, at least two action chambers between the hollow tubular stator and tubular rotor, each action chamber defined by an interior surface of the hollow tubular stator and an exterior surface of the tubular rotor, each action chamber sealed at one end by one of the rolling stator rod seals and at another end by one of the rolling rotor rod seals, the rolling stator rod seals and the rolling rotor rod seals movable in and from their respective recesses by the motive fluid, the rolling stator rods movable by the motive fluid to sealingly contact the rotor and roll along an exterior surface of the rotor, and the rolling rotor rod seals movable by the motive fluid to sealingly contact the stator and to roll along an interior surface of the stator, and the stator of the first motor disposed out-of-alignment with the stator of the second motor; such a motor wherein for each motor the at least two stator recesses is two diametrically opposed stator recesses, the at least two rotor recesses is two diametrically opposed rotor recesses, and the at least two action chambers is two diametrically opposed action chambers, so that a power couple is produced by the motor to impart a balanced driving load to the rotor; such a motor system wherein for each motor the at least two exhaust ports is two opposed exhaust ports for a balanced exhaust of motive fluid from the two action chambers; such a motor system wherein the motive fluid is a liquid; such a motor system wherein the motive fluid is a solvent; such a motor system wherein the motive fluid is a gas; such a motor system wherein for each motor the housing, the stator, the rotor, the rolling stator rod seals, and the rolling rotor rod seals are made of metal able to withstand at least 600° F. temperatures; such a motor system wherein the two stators are about ninety degrees out of phase; such a motor system wherein the motors are connected in series; such a motor system wherein the first motor is above the second motor and an amount of motive fluid supplied to the motor system flows through the first motor and exits therefrom and all the amount of motive fluid flows to the second motor, and all of the amount of motive fluid exits the motor system below the second motor for flow to the tool; such a motor system having motive fluid flowing through the motor, the motive fluid comprising a liquid solvent; such a motor system having the rotor of the first motor secured in-phase with the rotor of the second motor; and such a motor system wherein for each motor the stator has a jetting hole for conveying an amount of motive fluid into each stator recess to facilitate sealing contact of the rolling stator rod seals with the rotor. The present invention in other embodiments discloses a motor for rotating a tool attached thereto, the motor having a housing, a hollow tubular stator secured in the housing having at least two stator recesses therein and at least two exhaust ports therethrough, a rolling stator rod seal movably disposed in each stator recess and freely movable therein and therefrom, a tubular rotor movably disposed within the stator for rotation therein, the tubular rotor having an interior motive fluid flow channel therethrough and extending along the length of the rotor, the rotor having at least two continuously open radial flow channels therethrough for providing a motive fluid flow path for flow of motive fluid from the interior motive fluid flow channel to action chambers from which said fluid flows to the at least two opposed exhaust ports and to the tool, the tubular rotor having at least two rotor recesses and solid rolling rotor rod seals in each rotor recess, each rolling rotor rod seal freely movable from the rod recesses by force of the motive fluid to sealingly contact the stator, at least two action chambers between the hollow tubular stator and tubular rotor, each action chamber defined by an interior surface of the hollow tubular stator and an exterior surface of the tubular rotor, each action chamber sealed at one end by one of the rolling stator rod seals and at another end by one of the rolling rotor rod seals, the rolling stator rod seals and the rolling rotor rod seals movable in and from their respective recesses by the motive fluid, the rolling stator rods movable by the motive fluid to sealingly contact the rotor and roll along an exterior surface of the rotor, and the rolling rotor rod seals movable by the motive fluid to sealingly contact the stator and to roll along an interior surface of the stator, and the stator of the first motor disposed out-of-alignment with the stator of the second motor. The present invention discloses a method for cleaning crud from an interior of a tubular member, the method including inserting a motor system attached to a cleaning tool into the tubular member adjacent the crud, the motor system having a first motor and a second motor interconnected with the first motor, each motor having a housing, a hollow tubular stator secured in the housing having at least two stator recesses therein and at least two exhaust ports therethrough, a rolling stator rod seal movably disposed in each stator recess and freely movable therein and therefrom, a tubular rotor movably disposed within the stator for rotation therein, the tubular rotor having an interior motive fluid flow channel therethrough and extending along the length of the rotor, the rotor having at least two continuously open radial flow channels therethrough for providing a motive fluid flow path for flow of motive fluid from the interior motive fluid flow channel to action chambers from which said fluid flows to the at least two opposed exhaust ports and to the tool, the tubular rotor having at least two rotor recesses and solid rolling rotor rod seals in each rotor recess, each rolling rotor rod seal freely movable from the rod recesses by force of the motive fluid to sealingly contact the stator, at least two action chambers between the hollow tubular stator and tubular rotor, each action chamber defined by an interior surface of the hollow tubular stator and an exterior surface of the tubular rotor, each action chamber sealed at one end by one of the rolling stator rod seals and at another end by one of the rolling rotor rod seals, the rolling stator rod seals and the rolling rotor rod seals movable in and from their respective recesses by the motive fluid, the rolling stator rods movable by the motive fluid to sealingly contact the rotor and roll along an exterior surface of the rotor, and the rolling rotor rod seals movable by the motive fluid to sealingly contact the stator and to roll along an interior surface of the stator, and the stator of the first motor disposed out-of-phase with the stator of the second motor; flowing motive fluid to and through the motor system so it rotates the cleaning tool and exits therefrom to contact the crud; and the motive fluid comprising a fluid which degrades the crud.

It is, therefore, an object of at least certain preferred embodiments of the present invention to provide:

New, useful, unique, efficient, nonobvious devices and methods for drilling motor and systems with two or more drilling motors;

Such drilling motors with rolling vanes or rod seals disposed in stator recesses and in rotor recesses and freely movable radially therein to sealingly contact a rotor;

Such drilling motors in which fluid flows from a central rotor channel through radial rotor flow ports to effect rotor rotation;

A system with two or more such motors in series or in parallel; in one aspect with one motor out of phase with respect to another; and Such motors with two opposed action chambers to provide balanced coupled power and balanced exhaust.

The present invention recognizes and addresses the previously-mentioned problems and long-felt needs and provides a solution to those problems and a satisfactory meeting of those needs in its various possible embodiments and equivalents thereof. To one of skill in this art who has the benefits of this inventions'realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

BRIEF DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate only certain preferred embodiments of the invention and are therefore not to be considered limiting of its scope, for the invention may admit to other equally effective equivalent embodiments.

The apparatus of the invention is described with reference to the accompanying drawings, in which.

Figure 12A:
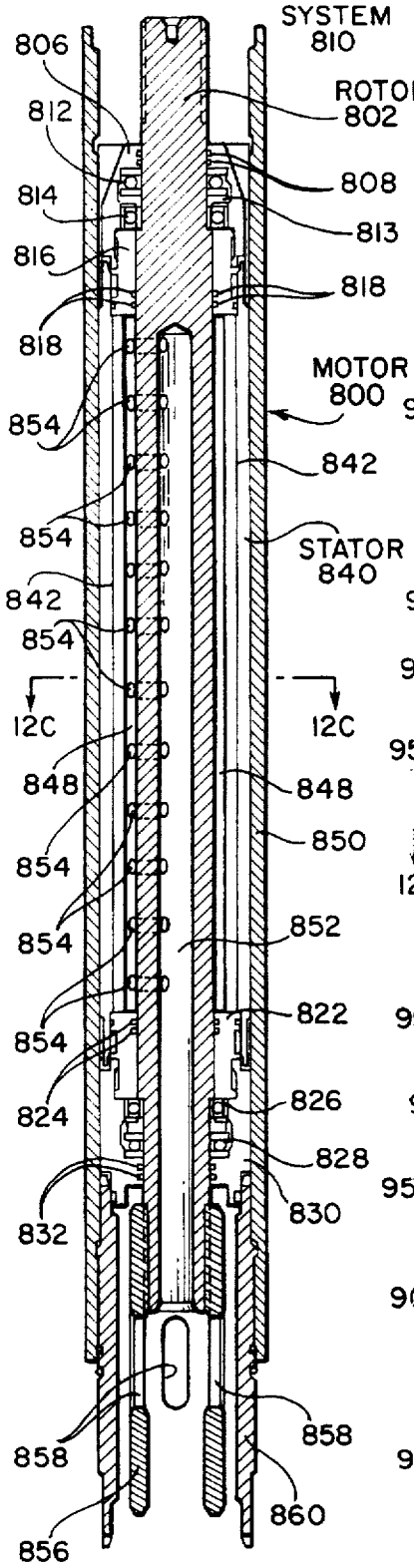
FIG. 12A is a longitudinal cross-sectional view of part of a drilling apparatus according to the present invention.
Figure 12B:
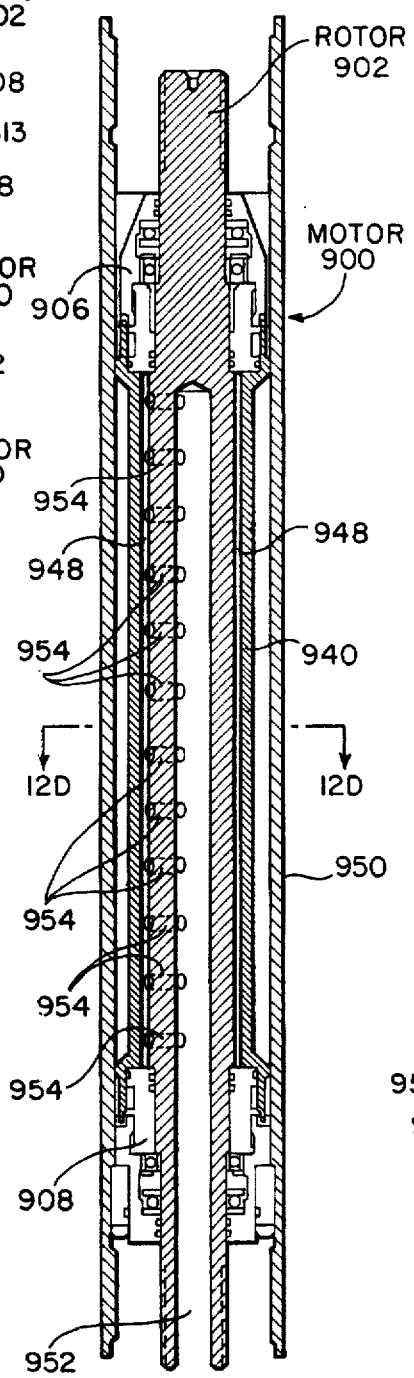
FIG. 12B is a longitudinal cross-sectional view of part of a drilling apparatus according to the present invention.
Figure 13A:
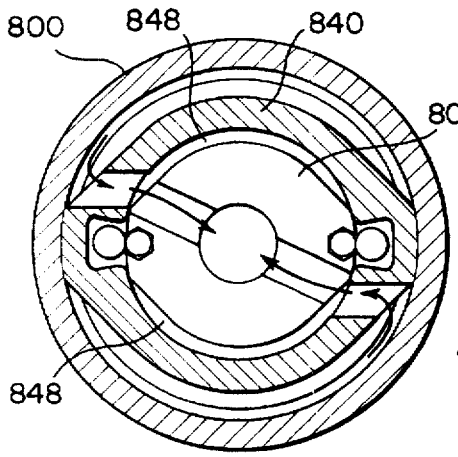
Figure 13B:
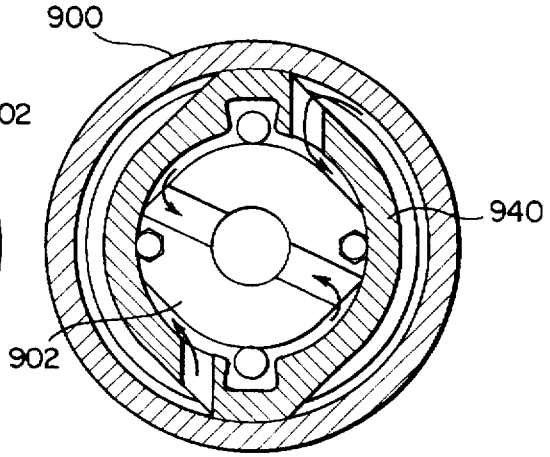

The pairs of FIGS. 13A, 13B; 14A, 14B; and 15A, 15B show the relative positions of rotors and stators in the motors of FIGS. 12A and 12B at various parts of the motors'cycles of operation.

FIG. 16 is a cross-section view of a motor according to the present invention.

DESCRIPTION OF PREFERRED EMBODIMENTS

Figure 1:
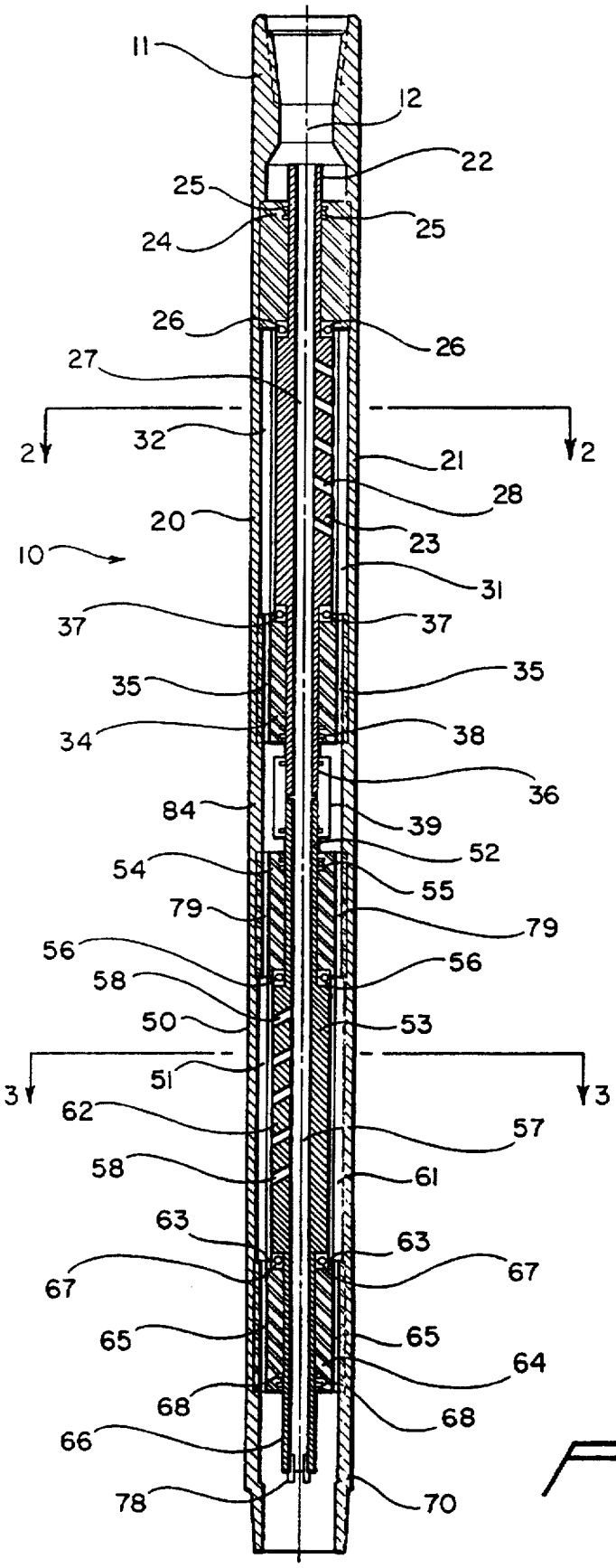
FIG. 1 is a longitudinal cross sectional view of drilling apparatus according to the present invention.

Referring now to FIG. 1, a system 10 according to the present invention has a first motor 20 according to the present invention and a second motor 50 according to the present invention. The first motor 20 has a stator 21 threadedly connected to a top sub 11. A top portion 22 of a rotor 23 extends through an upper metal block 24. Seals 25 (e.g. O-rings or a combination O-ring and PTFE seal) are disposed between the upper metal block 24 and the exterior of the top portion 22 of the rotor 23. The rotor 23 moves on bearings 26 with respect to the upper metal block 24.

Motive fluid, e.g. water or gas under pressure, flows down through a central sub channel 12 into a central rotor channel 27, and then out through rotor flow channels 28 into action chambers 31 and 32. Following a motor power stroke, the motive fluid flows down and through exhaust ports 33 into and through flow channels 35 in a lower metal block 34. A portion 36 of the rotor 23 extends through the lower metal block 34. The rotor 23 moves on bearings 37 with respect to the lower metal block 34 and seals 38 seal the rotor-metal block interface.

A splined union 39 joins a splined end of the rotor 23 to a splined end of the rotor 53 of a lower motor 50. The second motor 50 has a stator 51. The two stators 21 and 51 are interconnected with a stator adapter 84. A top portion 52 of a rotor 53 extends through an upper metal block 54. Seals 55 are disposed between the upper metal block 54 and the exterior of the top portion 52 of the rotor 53. The rotor 53 moves on bearings 56 with respect to the upper metal block 54.

Figure 4:
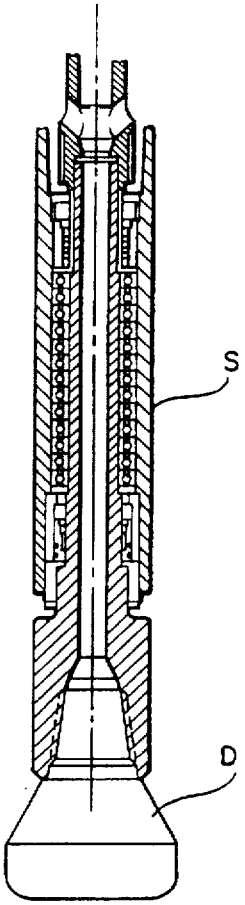
FIG. 4 is a cross sectional view of a typical drilling assembly.

Motive fluid flows into a central rotor channel 57 from the upper rotor's central channel 27 and then out through rotor flow channels 58 into action chambers 61 and 62. Following a motor power stroke, the motive fluid flows down and through exhaust ports 63 into and through flow channels 65 in a lower metal block 64. A portion 66 of the rotor 53 extends through the lower metal block 64. The rotor 53 moves on bearings 67 with respect to the lower metal block 64 and seals 68 seal the rotor-metal block interface. Also motive fluid which flowed through the channels 35 in the metal block 34, flows through channels 79 in the block 54, through the action chambers 61 and 62 and into the channels 65 in the block 64. A lower sub 70 is threadedly connected to the stator 51 and provides interconnection with a typical drill bit D (FIG. 4) and a typical drill bit connection/bearing housing S (FIG. 4). A solid plug or a flow restrictor 78 at the bottom of the rotor 53 may be used to restrict motive fluid flow to the bit D and to insure that a desired amount of motive fluid passes through the motors.

Figure 2A:
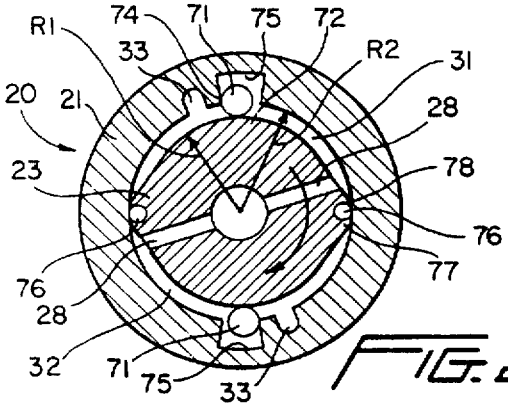
FIGS. 2*a*–2*d* are cross sectional views along line 2—2 of FIG. 1.
Figure 2B:
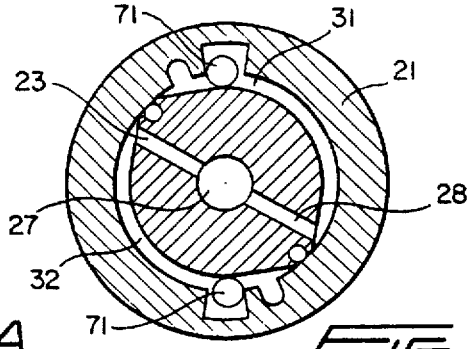
Figure 2C:
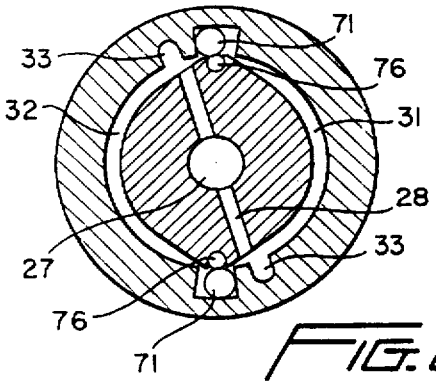
Figure 2D:
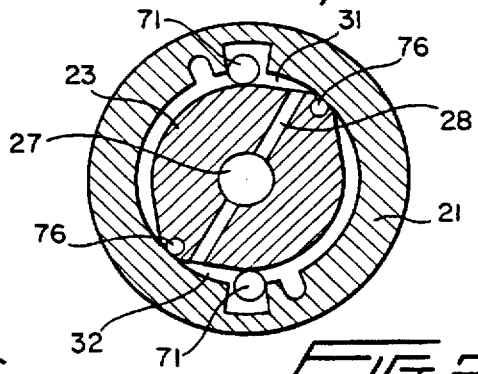
Figure 3A:
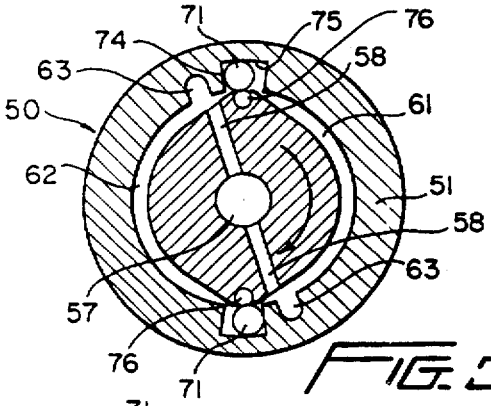
FIGS. 3*a*–3*d* are cross sectional views along line 3—3 of FIG. 1.
Figure 3B:
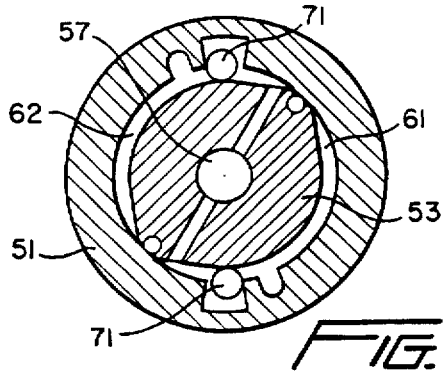
Figure 3C:
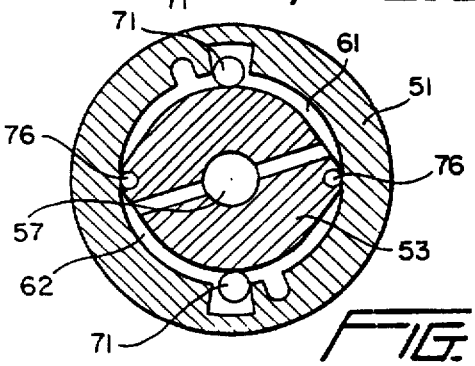
Figure 3D:
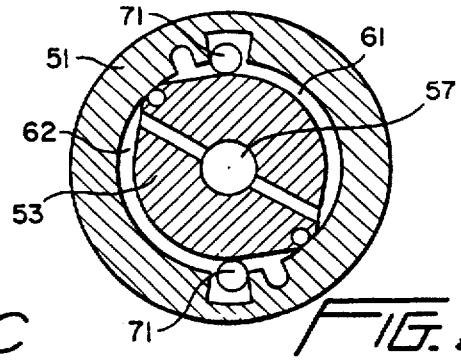

FIGS. 2A–2D and 3A–3D depict a typical cycle for the two motors 20 and 50 and show the status of the two motors with respect to each other at various times in the cycle. For example, FIG. 2C shows an exhaust period for the top motor 20 while FIG. 3C, at that same moment, shows a power period for the bottom motor 50.

As shown in FIG. 2A, motive fluid flowing through the flow channels 28 enters the action chambers 31 and 32. Due to the geometry of the chambers (as discussed below) and the resultant forces, the motive fluid moves the rotor in a clockwise direction as seen in FIG. 2B. The action chamber 31 is sealed at one end by a rolling vane rod 71 which abuts an exterior surface 72 of the rotor 23 and a portion 74 of a rod recess 75. At the other end of the action chamber 31, a seal 76 on a lobe 77 of the rotor 23 sealingly abuts an interior surface 78 of the stator 21. As shown in FIG. 2B, the rotor 23 has moved to a point near the end of a power period. The action chamber 32 and associated seals, rod, recess, and surfaces are like these items as discussed for the action chamber 31.

As shown in FIG. 2C, motive fluid is allowed to flow, at this point in the motor cycle, through the fluid flow channels 28, across the action chambers, and out through the exhaust ports 33. As shown in FIG. 2D, again the vane rods 71 and seals 76 have sealed off the action chambers and motive fluid flowing thereinto will move the rotor until the seals 76 again move past the exhaust ports 33.

The lower motor 50 operates as does the upper motor 20; but in certain preferred embodiments, and as shown in FIG. 3A–3D, the two motors are out of phase so that as one motor is exhausting motive fluid the other is providing power. For convenience similar parts in the motor 50 like those in the motor 20 (FIG. 2A) bear similar indicating numerals. The seals 76 are, in one embodiment, made preferably of PEEK, polyethylethylketone. The rolling vane rods are also most preferably made from PEEK. Rotors and stators are preferably made from corrosion resistant materials such as stainless steel.

In the rotational movement of the motors 20 and 50 a power couple is created and produced torque is two times the difference in radius of the radius R1 (FIG. 2A) and the radius R2 (FIG. 2A) multiplied by the length of the action chamber multiplied by the pressure difference of motive fluid on the intake side of the action chamber and the pressure on the output side of the action chamber times the average radius; e.g.:

$$T=(2 * ((R1-R2) * L * P * R3) / 12) * 2$$

where T =Torque in foot-lbs.

R1=Radius R1 in inches

R2=Radius R2 in inches

R3=Average Radius of R1 and R2 in inches

L=Length of rotor in inches

P=Pressure difference across rotor in lbs. per square inch

When a rotor seal 76 rotates past an exhaust port 33, the motive fluid that caused the turning exits and escapes downward to the motor union 39 (FIG. 1), then through the bearing housing S (FIG. 4) and subsequently to the bit D (FIG. 4). All motive fluid that enters the top sub 11 finally exits to the bit D.

The apparatus of FIG. 1 may be used as a pump by either manually or mechanically turning the bit D or housing S in a direction opposite to that of FIG. 2A; or by connecting a rotative mechanism to the lower rotor 53 and rotating it in a direction opposite to that of FIG. 2A. With the apparatus in a wellbore, this is achieved by jamming the bit into a formation so it does not turn and then rotating the tubular string above the apparatus of FIG. 1.

Figure 5:
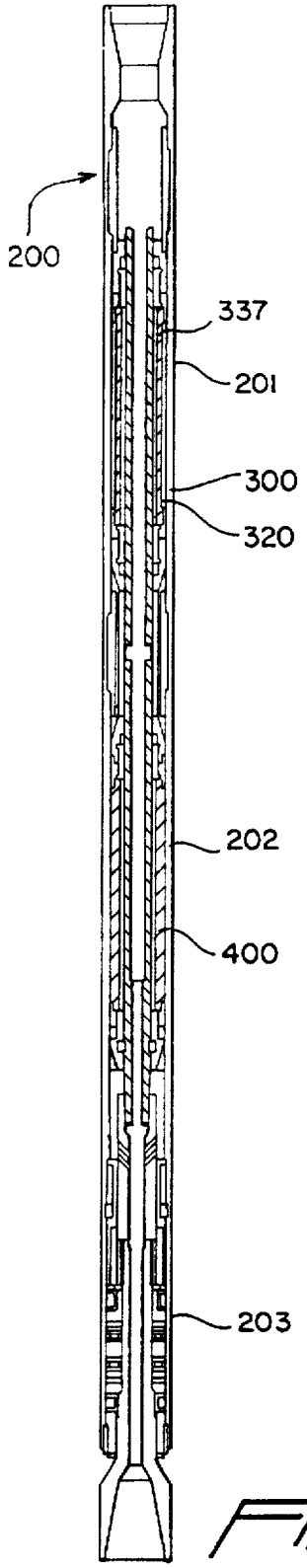
FIG. 5 is a side cross-sectional view of a system according to the present invention.

FIG. 5 illustrates a system 200 according to the present invention with an upper power module 201, a lower power module 202, and a bearing section (with a pressure compensator) 203. The upper power module 201 includes a downhole motor 300 according to the present invention and the lower power module 202 includes a downhole motor 400 according to the present invention. The two motors have rotors (or stators or a combination thereof) out of phase so that during an exhaust (non-power) stroke of one motor the other motor is providing power, via a rotor and rotor connector, to rotate a rotor of the other motor past and through its exhaust stroke. In one aspect the motors are ninety degrees out of phase for this purpose.

Figure 6A:
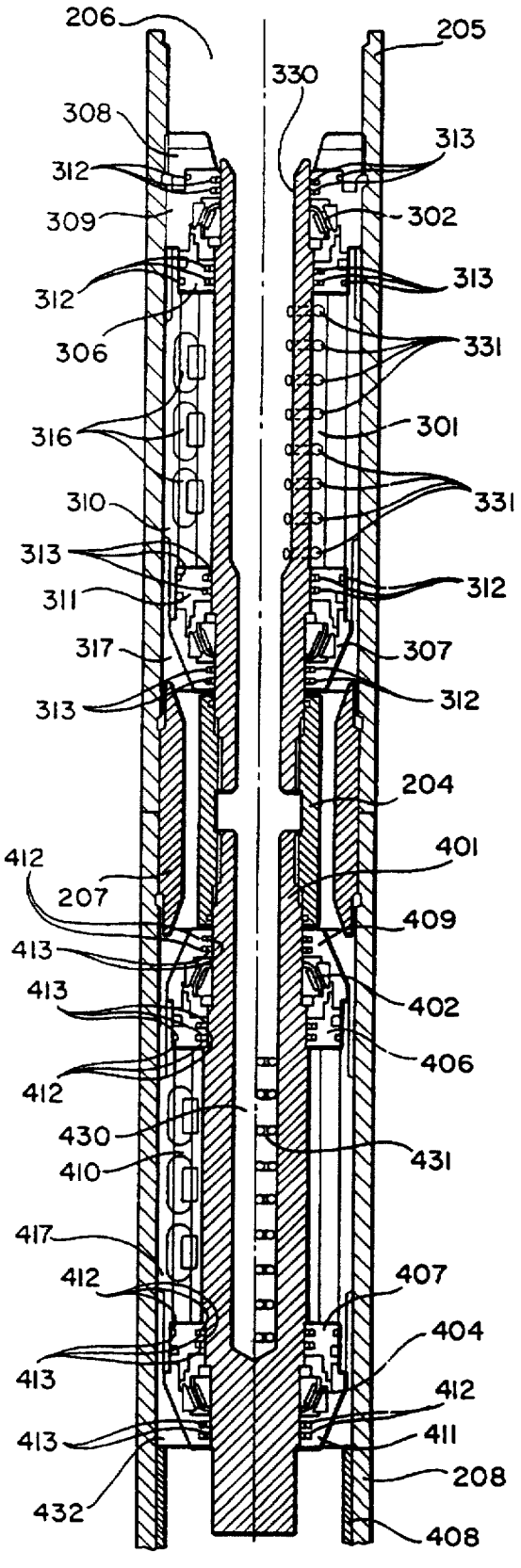
FIG. 6A is an enlargement of part of the system of FIG. 5.
Figure 6B:
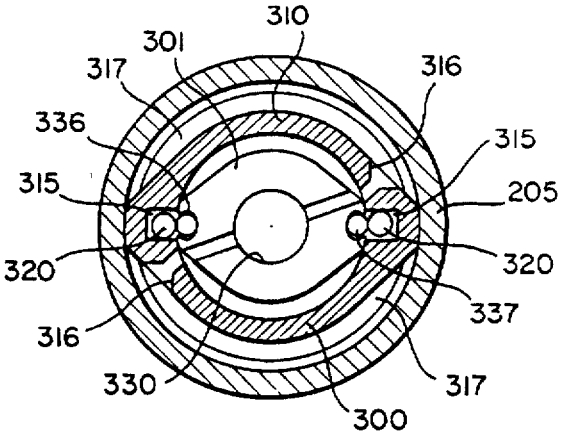
FIG. 6B is a top cross-sectional view at the point indicated with respect to FIG. 6A.
Figure 6C:
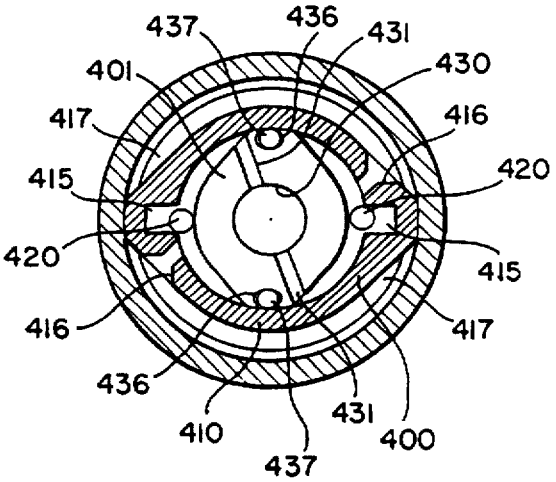
FIG. 6C is a top cross-sectional view at the point indicated with respect to FIG. 6A.

FIGS. 6A, 6B and 6C illustrate the downhole motors 300 and 400 and their relative positioning and interconnection. A rotor 301 of the top downhole motor 300 is connected to a rotor 401 of the bottom downhole motor 400 with a splined connection 204 that secures the two rotors together and maintains them in such a position with respect to each other that, as shown in FIGS. 6B and 6C, the motors are ninety degrees out of phase with respect to each other.

The rotor 301 is mounted on a bearing 302 (upper) and a bearing 304 (lower) which are held in place by bearing holders 306 (upper) and 307 (lower). An end nut 308 prevents the upper downhole motor 300 from exiting through a top opening 206 of a housing 205. A top seal holder 309 and a bottom seal holder 311 have recesses 317 (as do the bearing holders) and various seals 313 (made e.g. of Teflon (tm) material or polyethylethylketone) for sealing the interfaces between various parts of the motor 300 (e.g. the end nut, the rotor, a stator, etc.). It is preferred that static seals be Viton (tm) material, Aflas (tm) material, or Buna-N material; and that dynamic seals be two-piece energized seals with a typical O-ring behind and energizing a Teflon (tm) material or Teflon (tm) filled material seal member.

A stator 310 encircles and encloses the rotor 301. The stator 310 has two interior recesses 315, each with a rolling stator rod seal 320 freely and movably disposed therein. The stator 310 has two exhaust ports 316 through which motive fluid which has rotated the rotor 301 is exhausted into exhaust channel 317 between an exterior of the stator and an interior of the housing 205.

The rotor 301 has an interior flow channel 330 in fluid communication with a plurality of rotor flow ways 331 so that motive fluid flows through the interior flow channel 330, into the rotor flow ways 331 and into a space defined on either side of the rotor 301 by its exterior surface and the interior surface of the stator 310.

The rotor 401 is mounted on a bearing 402 (upper) and a bearing 404 (lower) which are held in place by bearing holders 406 (upper) and 407 (lower). A sleeve tube 408 (part of the bearing section 203) prevents the lower downhole motor 400 from exiting through the bottom of a housing 208. A seal holder 409 (upper) and a seal holder 411 (lower) have recesses 412 (as do the bearing holders) and various seals 413 for sealing the interfaces between various parts of the motor 400 (e.g. the end nut, the rotor, a stator, etc.)

A stator 410 encircles and encloses the rotor 401. The stator 410 has two interior recesses 415, each with a rolling seal rod 420 freely and movably disposed therein. The stator 410 has two exhaust ports 416, through which motive fluid (gas or liquid) which has rotated the rotor 401 is exhausted into exhaust channel 417 between an exterior of the stator and an interior of the housing 405.

The rotor 401 has an interior flow channel 430 in fluid communication with a plurality of rotor flow ways 431 so that motive fluid flows through the interior flow channel 430, into the rotor flow ways 431 and into a space defined on either side of the rotor 401 by its exterior surface and the interior surface of the stator 410. Exhausted fluid from both motors flows through an opening 432 down to apparatus, e.g. a bit, below the system 200.

A middle coupling 207 threadedly secures together the housing 205 and the housing 208.

As shown in FIGS. 6B and 6C, the upper downhole motor 300 is at an exhaust portion of its cycle of operation while, simultaneously, the lower downhole motor 400 is at a power portion of its cycle of operation. With the rotors of the motors secured together out of phase by the connector 204, one or the other of the motors is always providing power to turn the interconnected rotors.

With the motors disposed one above the other and with flow passages as shown and described, all of the motive fluid (gas or liquid) flowing into the top opening 206 flows out from bottom opening 432. It is within the scope of this invention, although not preferred, to exhaust a portion of the motive fluid to the exterior of the outer housings 205, 208. In one embodiment of the system 200, the rotor flow ways 331 are designed, sized, numbered, and configured so that about half of the motive fluid flowing into the opening 206 flows down to the lower downhole motor 400 and about half of the fluid flows out through the rotor flow ways 331 to power the upper downhole motor 300. This is achieved in one embodiment by sizing the rotor flow ways of the top motor so that their combined cross-sectional area equals about one half of the total cross-sectional area of the top rotor's interior flow channel.

Figure 7:
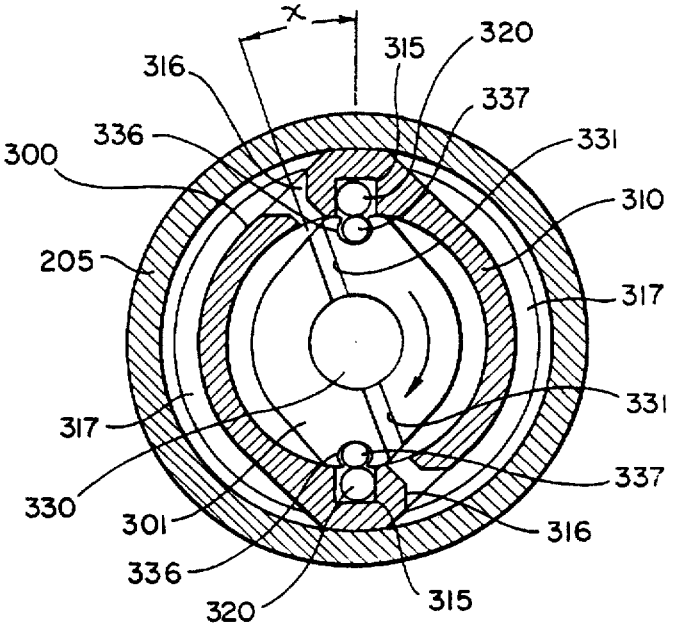
FIG. 7 is a top cross-sectional view showing one point in a cycle of operation of a motor of the system of FIG. 5.
Figure 8:
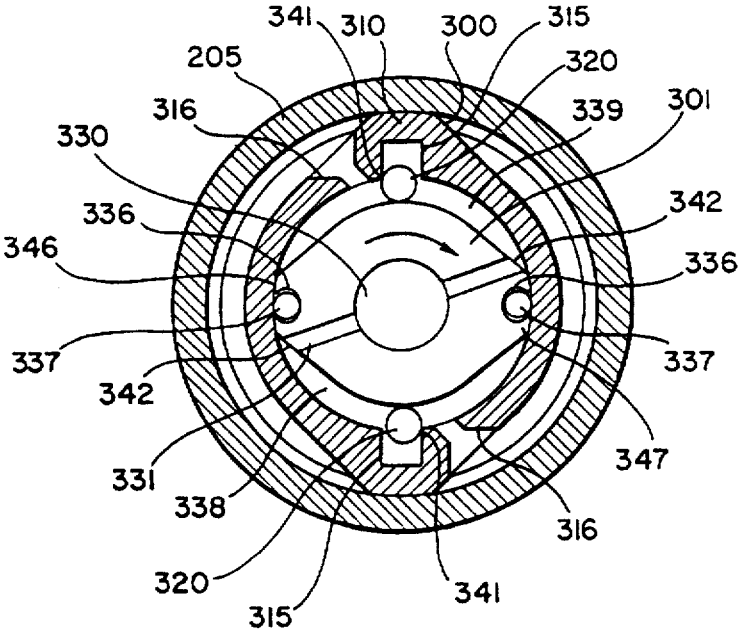
FIG. 8 is a top cross-sectional view showing one point in a cycle of operation of a motor of the system of FIG. 5.

FIGS. 7 and 8 illustrate various positions of the rotor 301 with respect to the stator 310 during the cycle of operation of the motor 300. Motive fluid flowing down through the interior channel 330 flows out through the rotor flow ways 331, through the chambers between the rotor 301 and the stator 310, and out through the exhaust ports into the exhaust areas 317, from which fluid flows downwardly to join with fluid exhausted from the lower motor 400. Hence there is a "dead band" for the cycle of the upper motor 300 which includes at least the arc "x" as shown in FIG. 7 during which only the lower motor 400 is supplying power to turn the rotor 301. Also for an arc "x" at this point during the cycle, motive fluid is not entering the recesses 336 or urging the rolling rotor seal rods 337 outwardly to sealingly contact the interior of the stator 310. The stator 310 is held in position in the outer housing, e.g. by a tooth/recess structure. In one aspect the rolling rotor seal rods protrude about 0.024 inches from their recesses 336 and, most preferably, the seal rods 337 contacting the seal rods 320 prevent the rotor edge from rubbing against the stator interior so that the rotor body does not contact the stator during operation.

FIG. 8 illustrates the rotor 301 in position so that the motive fluid, flowing into fluid chambers 338 and 339 on either side of the rotor 301 forces the rotor 301 to rotate. Ends of the chambers 338 and 339 are sealed by the rolling rotor rod seals 337 at one end and by the rolling stator rod seals 320 at the other end. The force of the motive fluid moves the rolling stator rod seals 320 out from their recesses 315 and holds them sealingly against the exterior surface of the rotor 301 and sealingly against a corner 341 of the recesses 315. Thus a balanced power couple is applied to the rotor 301 to rotate it. It is most preferred that the stator's interior (as viewed in cross-section as in FIGS. 7, 8) be circular or substantially circular and that the rotor 301 be substantially circular except for the lobed or ramped ends that have the recesses 336. The rotor turns clockwise in FIGS. 7 and 8. The recesses 336 and rods 337 are positioned to be adjacent the openings 342 of the rotor flow ways 331, so that the openings 342 are disposed between the rod pairs 337, 320 for the power stroke and so that the rod pairs sealingly contact each other for the exhaust stroke.

In certain preferred embodiments the rotor does not contact the stator at any point in the cycle of operation. As shown in FIG. 8, it is preferred that the rolling rotor rod seals 337 are pushed against the stator's interior by the motive fluid, which flows between the front edge of the rotor and the stator interior into the recesses 336 to force the rolling rotor rod seals 337 against the stator interior. If desired, to insure such fluid flow additional flow pathways may be provided through the rotor to the recesses 336 for the motive fluid. The recesses 315 are, preferably, sized and configured to permit the rolling stator seal rods 320 to move back therein during the exhaust stroke. The recesses 336 are disposed, sized and configured, as is the rotor 301, so that the rolling stator rod seals 320 cannot completely exit the recesses 336 and so that the seals 320 will sealingly roll along the primarily circular exterior surface of the rotor 301 and along the curved lobed or ramped ends 346 and 347.

Figure 9A:
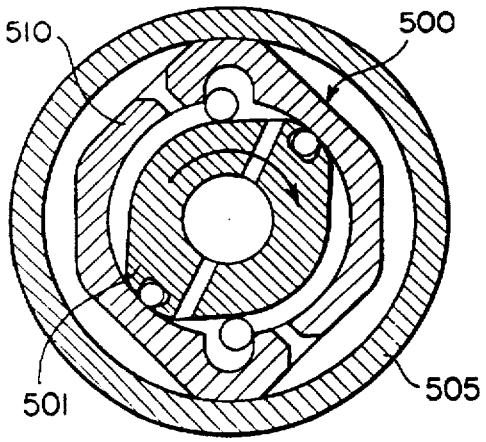
FIGS. 9A–10B are top cross-sectional views of motors according to the present invention.
Figure 9B:
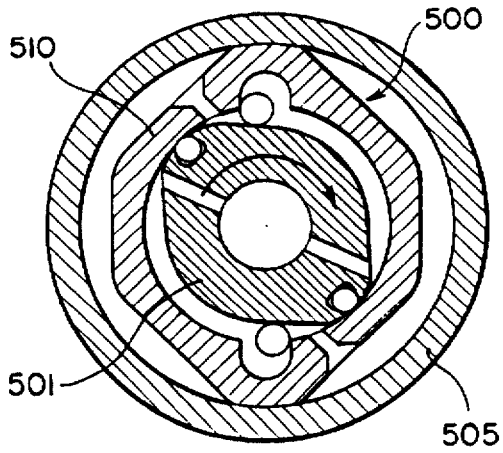
Figure 10A:
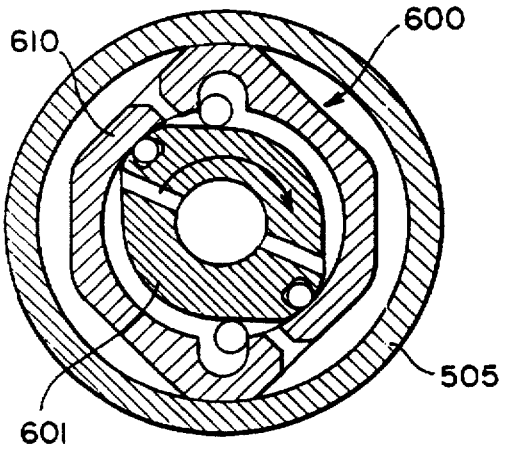
Figure 10B:
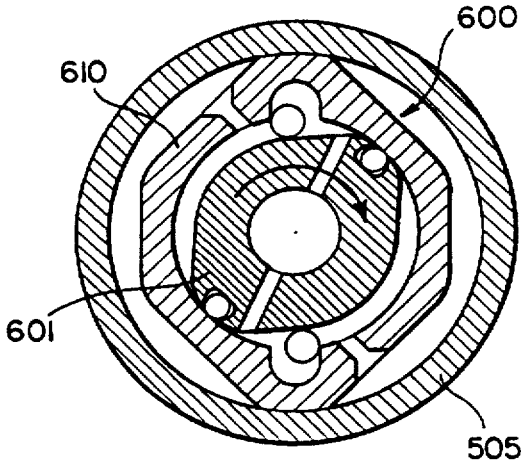

FIGS. 9A and 10A show motors 500, 600 (like the motors 300, 400, respectively) in a housing 505 in a system like the system 200; the motor 500 with a rotor 501 and a stator 510 and the motor 600 with a rotor 601 and a stator 610. The motors 500, 600 are ninety degrees out of phase and the motor 500 (FIG. 9A) is at the beginning of a power stroke while the motor 600 is simultaneously (FIG. 10A) nearing the end of a power stroke. Similarly the motor 500 (FIG. 9B) is nearing the end of a power stroke, just prior to an exhaust portion of the cycle, and the motor 600 (Fig. 10B) is near the beginning of a power stroke.

In the embodiments of FIGS. 9A and 10A an exterior of the motors' stators is relatively reduced in cross-sectional area as compared to stators with a substantially circular exterior cross-section. This facilitates the exhausting of fluid from the stator interior.

The rolling rotor rod seals and the rolling stator rod seals used in the motors disclosed and described herein are, preferably, solid and "roll" in the sense that they are free to rotate, as viewed from above, and they are also freely movable with no constraint (other than by stator and rotor surfaces or rod seal biasing members in the recesses) and without connection to the stator or to the rotor, and freely movable in and from their respective recesses in response to the force of motive fluid flowing into the recesses and forcing the entire rod seals therefrom. Preferably the rotor flow ways (e.g. flow ways 331, 431) are continuously open and are always unobstructedly interconnected with the rotor interior fluid flow channel (e.g. channels 330, 430) and no parts, moving or otherwise, are disposed in these flow ways. There is no flow through the rod seals. Each action chamber or power chamber defined by an exterior surface of the rotor and an interior surface of the stator is further defined by a pair including one stator rod seal and one rotor rod seal; and each end of an action chamber or power chamber is sealed either by a rolling stator rod seal or a rolling rotor rod seal. For sealing contact, nothing moves the rod seals other than the force of the motive fluid. The rolling rotor rod seals are allowed to protrude from their recesses sufficiently to effect the required continuous seal against the interior of the stator, but they are held and captured by their respective recesses so that they cannot protrude so far that they inhibit rotor movement or abut corners of the stator rod seal recesses to inhibit or prevent rotor rotation.

By loading the rotor with a power couple and by utilizing coupled exhaust so that a balanced force impacts opposing sides of the rotor, bending of the rotor is inhibited or prevented. Such couples achieved by the previously described motors facilitate smooth power output and inhibit stalling. Preferably the exhaust ports are diametrically opposed to each other and are configured with an opening that flares from a smaller area to a larger area as it extends away from the rotor (e.g. items 316, 416), thus facilitating smooth exhaust.

The stator, rotor, and rod seals of motors according to this invention may be made of metal including but not limited to steel, copper alloys, zinc, zinc alloys, brass, and any type of stainless steels. Certain conventional Moineau motors with various non-metal parts have problems at temperatures of 250° F. (121° C.) or higher. Motors according to the present invention made with metal parts are operable in environments at temperatures up to 600° F. (315° C.). Different parts of the motors may be made of different materials. The housing may be made of metal. The rod seals may be made of plastic, composites, metal, polyethylethylketone, and their equivalents.

The motors described and claimed herein may be used in series or in parallel. Such motors may be used as a pump;

e.g., by either manually or mechanically turning a drill bit interconnected with a motor or a housing of the motor in a direction opposite to the normal motor rotative motion, or by connecting rotative mechanism to a rotor and rotating in said opposite direction.

Figure 11A:
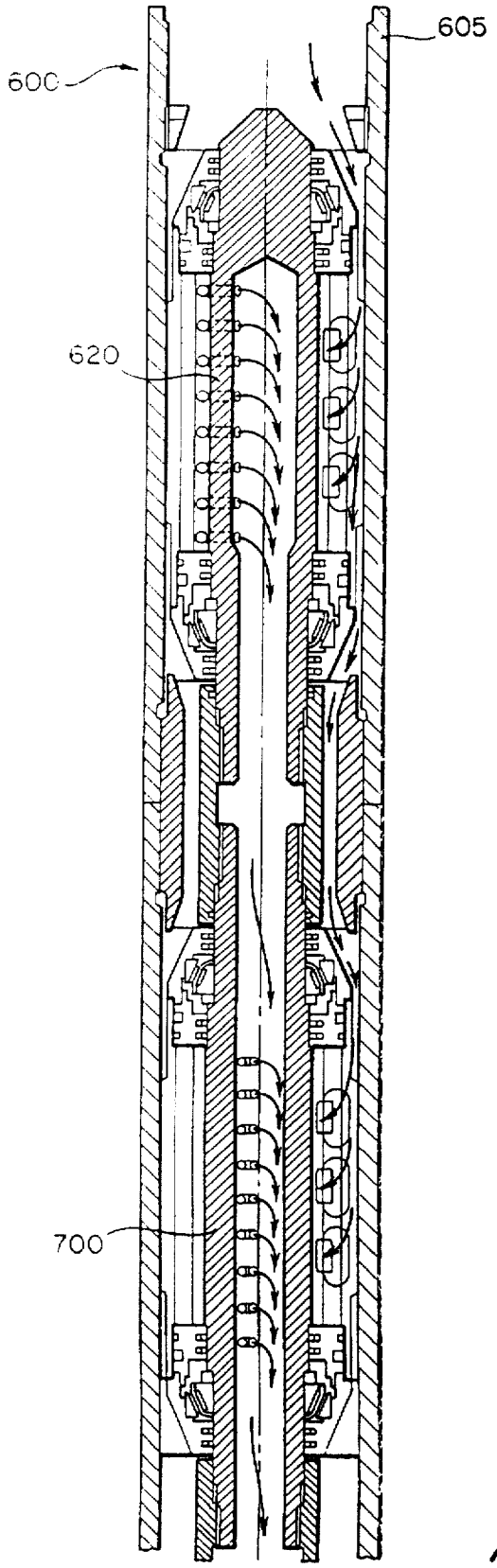
FIG. 11A is an enlargement of part of the system of FIG. 5.
Figure 11B:
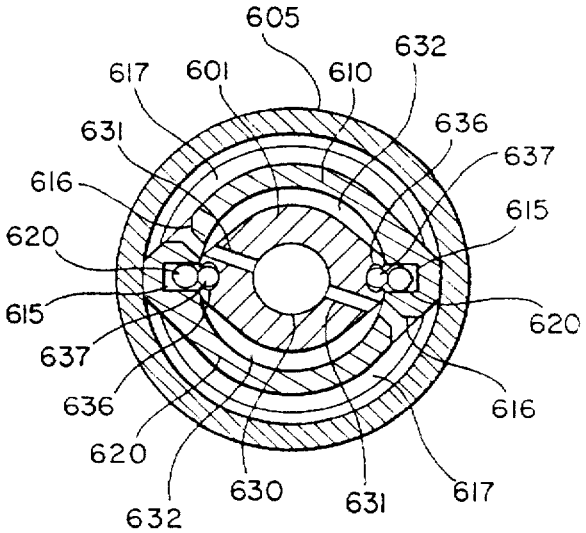
FIG. 11B is a top cross-sectional view at the point indicated with respect to FIG. 11A.
Figure 11C:
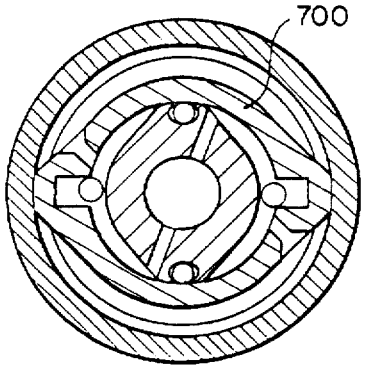
FIG. 11C is a top cross-sectional view at the point indicated with respect to FIG. 11A.

FIGS. 11A, 11B and 11C show a motor system 600 according to the present invention like the system 200, but with an opposite fluid flow regime, i.e., motive fluid introduced at the top of the system initially flows into the cavities 617 between the interior of a housing 605 and the exterior of a stator 610 of a motor 620; then through entry ports 616 into action chambers 632, causing a rotor 601 to rotate (clockwise in FIG. 11B) until exhaust ports 631 (like the rotor flow ways 331) are exposed so the motive fluid can exhaust through an interior channel 630 of the rotor 601. Rolling rotor rod seals 637 in recesses 636 and rolling stator rod seals 620 in recesses 615 are like previously described rod seals; but as shown in FIGS. 11B and 11C the exhaust ports 631 extend to a right side (as viewed in the Figs.) of the recesses 636. A lower motor 700, ninety degrees out of phase with the upper motor 620, is like the motor 620. Parts in the system 600 like the parts of the system 200 are not labelled with numerals. The arrows in FIG. 11A show the motive fluid flow path through the device.

Although several motors have been described with two action chambers, a dual lobed rotor with two opposed rotor rod seals, and a stator with two complimentary stator rod seals, it is within the scope of this invention to provide a rotor with any desired number of lobes and seals and an associated stator with the desired number of complimentary seals, or with one or more additional seals as compared to the rotor.

In one method according to the present invention a chemical, solvent or cleaning fluid is the motive or drive fluid for a motor or motor system as previously described. By flowing the motive cleaning fluid out from a tool, bit, or cleaning tool connected to the motor or motor system, the fluid itself helps to clean a tubular interior and/or break down or degrade materials ("crud") which have accumulated on or caked on the tubular's interior. Such fluids may be heated prior to introduction to the motor.

Certain embodiments of motor systems according to the present invention will have the following dimensions and characteristics. "Motor Length" is for a motor system with two motors as described herein. "Flow Rate" is for motive or drive fluid flow. "Differential Pressure" indicates pressure drop from one end (top) of the system to another end (bottom). "Overpull" indicates the amount of pulling force that may be applied to the system (e.g. if it is stuck). "Motor Size" is motor system outside diameter.

| | | | |
|---|---|---|---|
| Motor Size | 1-11/16" | 2-1/8" | 3-1/8" |
| Motor Length | 3' | 4' 7" | 5' 9" |
| Rod Seal Length | 7.5" | 8" | 11" |
| Weight (approx. in lbs) | 26 | 52 | 112 |
| Maximum Flow Rate (gpm) | 30 | 50 | 110 |
| Minimum Flow Rate (gpm) | 14 | 23 | 50 |
| Maximum Differential Pressure (psi) | 1200 | 1200 | 1200 |
| Maximum Rotor Rotational Speed (rpm) | 1000 | 900 | 700 |
| Maximum Torque (ft-lbs) | 40 | 80 | 300 |
| Maximum Weight On Bit (lbs) | 3000 | 10,000 | 20,000 |
| Maximum Overpull (lbs) | 7000 | 15,000 | 45,000 |

By comparison a conventional Moineau type motor that delivers 40 foot-pounds of torque is at least about 8 feet long; 1150 ft-lbs, about 20 feet long. In one 2-⅛" motor system the rolling rotor rod seals have a cross-sectional diameter of about 0.160 inches and the rolling stator rod seals are about 0.188 inches in cross-sectional diameter.

In certain preferred embodiments it is preferred that the rolling rod seals be substantially cylindrical; that the stator recesses for the rolling stator rod seals be three-sided and located in enlarged lobed parts of the stator which contact the inner wall of the housing with the recesses adjacent the exhaust ports; that the rotor recesses for the rolling rotor rod seals have a recessed space slightly larger than the rod seals themselves with end fingers or lips partially defined by a curved outer surface of the rotor's lobed portions and partially defined by part of the interior surface of the recess whereby the rod seals are maintained in the recesses so that a curved portion of the rod seal's exterior surface protrudes outwardly through a gap between the fingers or lips to sealingly contact (due to the force of motive fluid) and sealingly roll along the stator's interior surface. In certain embodiments a biasing device or member is emplaced in the recesses between a surface of the recess and the rolling rod seals to urge the rolling rod seals (rotor and/or stator) outwardly from their recesses, preferably without inhibiting rod seal rotation; e.g. a member or members along some or all of the entire length of the rod recess made from foam (open or closed cell), rubber, or plastic.

Referring now to FIGS. 12A–12D, a system 810 according to the present invention has a first motor 800 according to the present invention and a second motor 900 according to the present invention. The first motor 800 has a housing 850 threadedly connectible to a top sub (not shown). A rotor 802 extends through an upper metal block 806 with seals 808, through a thrust bearing 812, through a radial bearing 814, through a spacer 813, through a seal block 816 with rotary seals 818 and through similar structure at the lower end of the rotor 802 which includes a seal block 822 with rotary seals 824, a radial bearing 826, a thrust bearing 828, and a lower metal block 830 with seals 832. A stator 840 encircles and encloses the rotor 802.

The stator 840 has two interior recesses 842, each with a rolling seal rod 844 freely and movably disposed therein. The stator 840 has a plurality of intake ports 846 (e.g. forty six in a twelve inch motor) through which motive fluid for rotating the rotor 802 enters into action chambers 848 between an interior of the stator 840 and an exterior of the rotor 802. This fluid exhausts out from an exhaust channel 852 in the rotor which is in fluid communication with exhaust ports 854 of the rotor 802.

A rotor receiver connector 856 secured on the rotor 802 receives and holds the rotor 902 of the motor 900. The housing 850 is threadedly connected to a connector 860 which is also threadedly connected to a housing 950 of the motor 900. The rotor receiver connector 856 has a plurality of flow windows 858 (e.g. one, two, four, six) through which motive fluid exhausted from the motor 800 flows down to the exterior of a stator 940 of the motor 900.

The motive fluid flows in an "outside-in" path through the motor 800, i.e., from outside the stator 840, through the stator 840, through the ports 846 into action chambers 848, and (after turning of the rotor past a rolling rod seal) into exhaust ports 854 and out through the exhaust channel 852.

The motor 900 with the housing 950 is mounted in an upper mounting structure 906 (like the upper metal block 806 etc. of the motor 800) and a lower mounting structure 908 (similar to the lower metal block 830 etc. of the motor 800).

The stator 940 has two interior recesses 942, each with a rolling seal rod 944 freely and movably disposed therein. The stator 940 intake ports 946 through which motive fluid for rotating the rotor 902 enters into action chambers 948 between an interior of the stator 940 and an exterior of the rotor 902. This fluid exhausts out from an exhaust channel 952 in the rotor which is in fluid communication with exhaust ports 954 of the rotor 902.

The motive fluid flows in an "outside-in" path through the motor 900, i.e., from outside the stator 940, through the stator 940, through the intake ports 946 into action chambers 948, and (after turning of the rotor past a rolling rod seal) into exhaust ports 954 and out through the exhaust channel 952. The two motors 800 and 900 are connected in series so that the exhaust from the motor 800 flows to the motor 900. The exhaust from the motor 900 flows down to a sub with a drill bit (not shown) or other device. A bit sub or other sub as described above may be used. Fluid initially flows to the top motor 800, e.g. through a top housing (not shown) to the exterior of the stator 840. In one aspect a floating thread coupling is used to connect the top housing to the housing 850 of the motor 800. In one aspect the connector 860 is a keyed floating thread coupling for interconnecting the two motors.

Figure 12C:
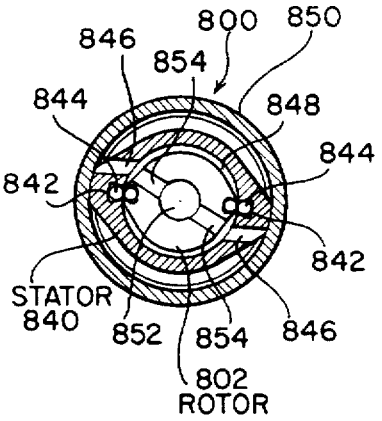
FIG. 12C is a cross-sectional view along line 12C—12C of FIG. 12A.
Figure 12D:
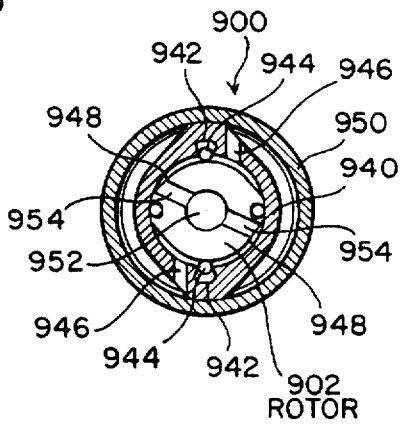
FIG. 12D is a cross-sectional view along line 12C—12C of FIG. 12A.

As shown in FIGS. 12C and 12D the motors 800 and 900 are out of phase, i.e. as shown the motor 800 is at an exhaust part of its cycle of operation while, simultaneously, the motor 900 is at a power part of its cycle of operation. With the stators 840, 940, (e.g. 90 degrees out of phase and secured in the housing by, e.g. a floating threaded coupling (e.g. connecctor 860) keyed to a metal block (e.g. 830), with the metal block keyed to the stator and the rotors 802, 902 secured together by the connector 856, one motor or the other always provides power to turn the interconnected rotors and the bit. Preferably the connector 856 secures the two rotors together so they rotate together, but allows freedom of movement longitudinally of one rotor with respect to the other; e.g. with a splined movable interconnecting structure for each rotor or a hexagonally shaped rotor end structure received in a corresponding mating shaped recess on each end of the connecctor.

Figure 14A:
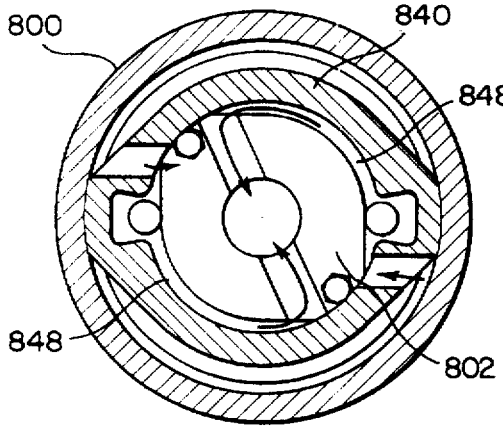
Figure 14B:
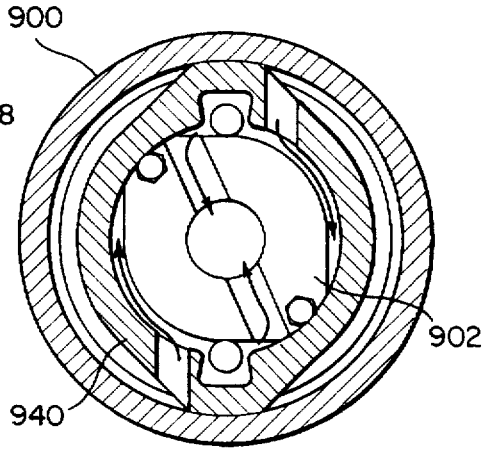
Figure 15A:
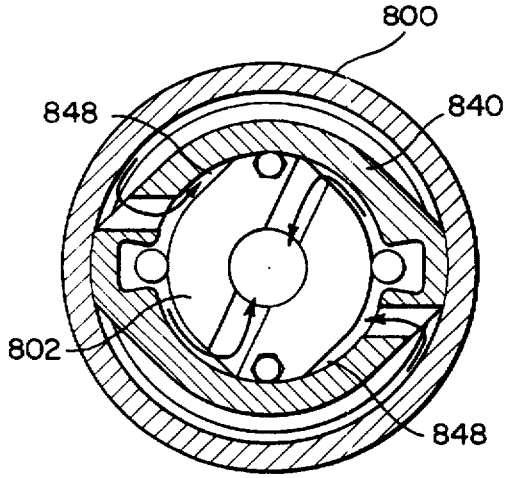
Figure 15B:
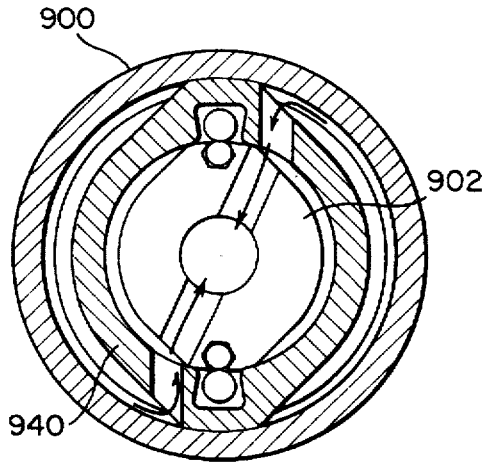
Figure 18:
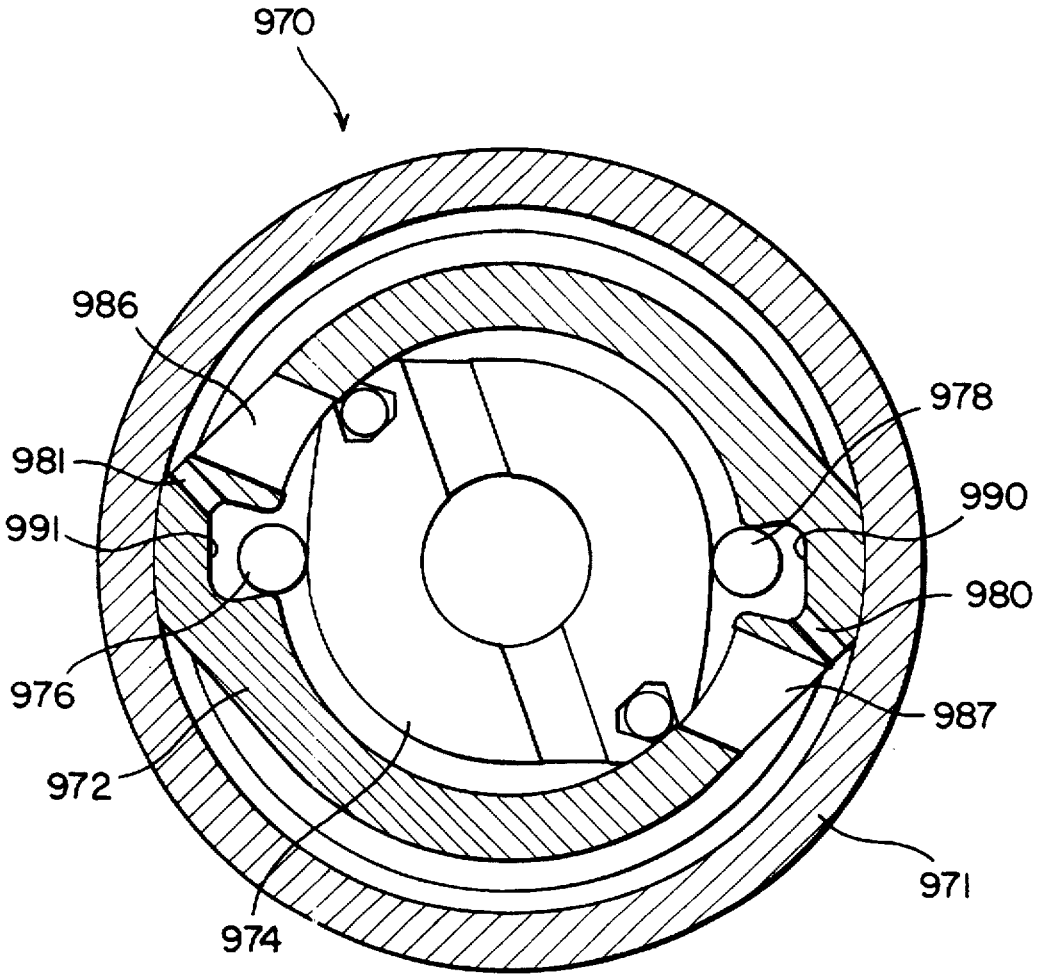

As shown in FIG. 13A when the motor 800 is bypassing motive fluid the motor 900 is delivering power. As shown in FIG. 14A when the motor 800 is receiving motive fluid into its action chambers to rotate the rotor 802, so is the motor 900. As shown in FIGS. 15A, 15B when the motor 900 is bypassing motive fluid, the motor 800 is delivering power. The arrows generally indicate fluid flow direction.

FIG. 16 shows a motor 970 (like the motors shown in FIGS. 12A–15B) with additional jetting holes 980, 981 in fluid communication with the space between a housing 971 and a stator 972 so that an amount of the motor's motive fluid flows through the jetting holes in stator recesses 990, 991, respectively, to facilitate sealing contact of rolling stator rods 976, 978 with a rotor 974. The motor 970 has intake ports 986, 987. Each stator in a two-motor system using a motor 970 has one or more pairs of jetting holes (like the holes (980, 981); e.g. for a twelve-inch motor (outer housing twelve inches in outer diameter) three pairs of jetting holes are used for a stator which is about eighteen inches long.

In conclusion, therefore, it is seen that the present invention and the embodiments enclosed herein and those covered by the appended claims are well adapted to carry out the objectives and obtain the ends set forth. Certain changes can be made in the described and in the claimed subject-matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A motor for rotating a tool attached thereto, the motor comprising a housing, a hollow tubular stator secured in the housing having at least two stator recesses therein and at least two intake ports therethrough, a rolling stator rod seal movably disposed in each stator recess and freely movable therein and therefrom, a tubular rotor movably disposed within the stator for rotation therein, the tubular rotor having an interior exhaust fluid flow channel therethrough and extending along the length of the tubular rotor, the tubular rotor having at least two continuously open radial exhaust channels therethrough in fluid communication with the interior exhaust fluid flow channel, the tubular rotor having at least two rotor recesses and solid rolling rotor rod seals in each rotor recess, each rolling rotor rod seal freely movable from the rod recesses by force of the motive fluid to sealingly contact the stator, at least two action chambers between the hollow tubular stator and tubular rotor, each action chamber defined by an interior surface of the hollow tubular stator and an exterior surface of the tubular rotor, each action chamber sealed at one end by one of the rolling stator rod seals and at another end by one of the rolling rotor rod seals, said motive fluid flowable through the intake ports of the hollow tubular stator, into the interior stator space and the at least two action chambers, through the at least two continuously open radial exhaust channels of the tubular rotor, and into the interior exhaust fluid flow channel of the tubular rotor, and the rolling stator rod seals and the rolling rotor rod seals movable in and from their respective recesses by the motive fluid, the rolling stator rods movable by the motive fluid to sealingly contact the rotor and roll along an exterior surface of the rotor, and the rolling rotor rod seals movable by the motive fluid to sealingly contact the stator and to roll along an interior surface of the stator.

2. A motor system for rotating a tool attached thereto, the motor system comprising a first motor and a second motor interconnected with the first motor, each motor further comprising a housing, a hollow tubular stator secured in the housing having at least two stator recesses therein and at least two intake ports therethrough, an interior wall of the stator defining an interior stator space, a rolling stator rod seal movably disposed in each stator recess and freely movable therein and therefrom, a tubular rotor movably disposed within the stator for rotation therein, the tubular rotor having an interior exhaust fluid flow channel therethrough and extending along the length of the tubular rotor, the tubular rotor having at least two continuously open radial exhaust channels therethrough in fluid communication with the interior exhaust fluid flow channel, the tubular rotor having at least two rotor recesses and solid rolling rotor rod seals in each rotor recess, each rolling rotor rod seal freely movable from the rod recesses by force of the motive fluid to sealingly contact the stator, at least two action chambers between the hollow tubular stator and tubular rotor, each action chamber defined by an interior surface of the hollow tubular stator and an exterior surface of the tubular rotor, each action chamber sealed at one end by one of the rolling stator rod seals and at another end by one of the rolling rotor rod seals, said motive fluid flowable through the intake ports of the hollow tubular stator, into the interior stator space and the at least two action chambers, through the at least two continuously open radial exhaust channels of the tubular rotor, and into the interior exhaust fluid flow channel of the tubular rotor, the rolling stator rod seals and the rolling rotor rod seals movable in and from their respective recesses by the motive fluid, the rolling stator rods movable by the motive fluid to sealingly contact the rotor and roll along an exterior surface of the rotor, and the rolling rotor rod seals movable by the motive fluid to sealingly contact the stator and to roll along an interior surface of the stator, and the stator of the first motor disposed out-of-alignment with the stator of the second motor.

3. The motor system of claim 2 wherein for each motor the at least two stator recesses is two diametrically opposed stator recesses, the at least two rotor recesses is two diametrically opposed rotor recesses, and the at least two action chambers is two diametrically opposed action chambers, so that a power couple is produced by the motor to impart a balanced driving load to the rotor.

4. The motor system of claim 3 wherein for each motor the at least two continuously open radial exhaust channels of the tubular rotor is two opposed exhaust channels for a balanced exhaust of motive fluid from the two action chambers.

5. The motor system of claim 2 wherein the motive fluid is a liquid.

6. The motor system of claim 5 wherein the motive fluid is a solvent.

7. The motor system of claim 2 wherein the motive fluid is a gas.

8. The motor system of claim 2 wherein for each motor the housing, the hollow tubular stator, the tubular rotor, the rolling stator rod seals, and the rolling rotor rod seals are made of metal able to withstand at least 600° F. temperatures.

9. The motor system of claim 2 wherein the two hollow tubular stators are about ninety degrees out of phase.

10. The motor system of claim 2 wherein the motors are connected in series.

11. The motor system of claim 2 wherein the first motor is above the second motor and an amount of motive fluid supplied to the motor system flows through the first motor and exits therefrom and all the amount of motive fluid flows to the second motor, and all of the amount of motive fluid exits the motor system below the second motor for flow to the tool.

12. The motor system of claim 2 further comprising motive fluid flowing through the motor, the motive fluid comprising a liquid solvent.

13. The motor system of claim 2 further comprising the tubular rotor of the first motor secured in-phase with the tubular rotor of the second motor.

14. The motor system of claim 2 wherein for each motor the stator has a jetting hole for conveying an amount of motive fluid into each stator recess to facilitate sealing contact of the rolling stator rod seals with the rotor.

15. A method for cleaning crud from an interior of a tubular member, the method comprising inserting a motor system attached to a cleaning tool into the tubular member adjacent the crud, the motor system comprising a first motor and a second motor interconnected with the first motor, each motor further comprising a housing, a hollow tubular stator secured in the housing having at least two stator recesses therein and at least two intake ports therethrough, a rolling stator rod seal movably disposed in each stator recess and freely movable therein and therefrom, a tubular rotor movably disposed within the stator for rotation therein, the tubular rotor having an interior exhaust fluid flow channel therethrough and extending along the length of the tubular rotor, the tubular rotor having at least two continuously open radial exhaust channels therethrough in fluid communication with the interior exhaust fluid flow channel, the tubular rotor having at least two rotor recesses and solid rolling rotor rod seals in each rotor recess, each rolling rotor rod seal freely movable from the rod recesses by force of the motive fluid to sealingly contact the stator, at least two action chambers between the hollow tubular stator and tubular rotor, each action chamber defined by an interior surface of the hollow tubular stator and an exterior surface of the tubular rotor, each action chamber sealed at one end by one of the rolling stator rod seals and at another end by one of the rolling rotor rod seals, said motive fluid flowable through the intake ports of the hollow tubular stator into the interior stator space and the at least two action chambers, through the at least two continuously open radial exhaust channels of the tubular rotor, and into the interior exhaust fluid flow channel of the tubular rotor, the rolling stator rod seals and the rolling rotor rod seals movable in and from their respective recesses by the motive fluid, the rolling stator rods movable by the motive fluid to sealingly contact the rotor and roll along an exterior surface of the rotor, and the rolling rotor rod seals movable by the motive fluid to sealingly contact the stator and to roll along an interior surface of the stator, and the stator of the first motor disposed out-of-phase with the stator of the second motor, flowing motive fluid to and through the motor system so it rotates the cleaning tool and exits therefrom to contact the crud, and the motive fluid comprising a fluid which degrades the crud.

* * * * *